United States Patent [19]

Lehrman

[11] Patent Number: 4,603,494

[45] Date of Patent: Aug. 5, 1986

[54] NON-SKID IRONING BOARD COVER

[76] Inventor: David Lehrman, c/o The Ironees Company, Front & Venango St., Philadelphia, Pa. 19134

[21] Appl. No.: 711,683

[22] Filed: Mar. 15, 1985

[51] Int. Cl.[4] ..... D06F 83/00

[52] U.S. Cl. ..... 38/140; 428/290; 524/215

[58] Field of Search ..... 524/215; 428/522, 290, 428/319.3; 38/140, 66, 68; 73/864.9

[56] References Cited

U.S. PATENT DOCUMENTS

| | | | |
|---|---|---|---|
| 1,797,758 | 3/1931 | Davis | 38/66 |
| 2,570,110 | 10/1951 | Glatt | 38/140 |
| 2,704,730 | 3/1955 | Glatt | 38/140 X |
| 2,807,895 | 10/1957 | Hicks | 38/66 |
| 2,874,471 | 2/1959 | Palmer | 38/137 X |
| 3,049,826 | 8/1962 | Goldsmith . | |
| 3,148,467 | 9/1964 | Kerr . | |
| 3,414,995 | 12/1968 | Adiletta et al. . | |
| 3,671,303 | 6/1972 | Meitner | 524/215 X |
| 3,733,724 | 5/1973 | Davis . | |
| 3,911,603 | 10/1975 | Lehrman . | |
| 4,043,062 | 8/1977 | Lehrman . | |
| 4,360,984 | 11/1982 | Ruttenberg . | |
| 4,459,865 | 7/1984 | Welker | 73/864.91 X |

FOREIGN PATENT DOCUMENTS

| | | | |
|---|---|---|---|
| 2467256 | 10/1979 | France | 38/66 |
| 632781 | 11/1979 | U.S.S.R. | 38/140 |

*Primary Examiner*—Werner H. Schroeder
*Assistant Examiner*—Andrew M. Falik
*Attorney, Agent, or Firm*—Seidel, Gonda, Goldhammer & Abbott

[57] ABSTRACT

A cover for an ironing board or pressing machine is provided with non-skid characteristics to prevent articles being ironed from sliding under the influence of gravity. The non-skid surface, which extends at least over a portion of the ironing surface, is preferably formed from an acrylic polymer stable at normal ironing temperatures. The coating may be applied as a composition containing the following ingredients by volume: about 50–95% of an aqueous acrylic emulsion, about 0.5–3% thickener, about 0.5–2% of a thickener activator, about 0.5–5% humectant, and water.

11 Claims, No Drawings

NON-SKID IRONING BOARD COVER

BACKGROUND OF THE INVENTION

This invention relates to a cover for an ironing board or pressing machine including a skid-resistant material which provides frictional force between the cover and the articles to-be-ironed, thereby preventing the articles from sliding on the ironing surface.

During the ironing process, whether domestic, commercial or industrial, considerable difficulty may be encountered when more than half of the article being ironed extends over the edge of the ironing board. Since the conventional board cover is typically composed of a relatively slick woven textile, the force of gravity tends to pull the article off the board onto the floor. To prevent the garment from falling, the ironer must keep one hand on the article as a restraint to fix its position on the board. Ironing becomes awkward, time consuming and subject to repeated dropping mishaps.

After one or more ironing strokes, the ironer may temporarily place the iron, sole plate down, on the ironing surface aside the article being ironed, usually near the heel or untapered end of the ironing board. The iron may rest in this location while the ironer shifts, folds, hangs or replaces the article ironed. Any contact or bump to the ironing board may cause the iron to slide off the board, inasmuch as the sole plate of the iron is ultra smooth and polished, and the conventional ironing board cover is a woven textile material with minimal or no surface traction.

Generally, ironing board covers are made from coated cotton or other textile materials, or partially or entirely of man-made fibers. The typical ironing surface is slippery, affording little or no friction between the cover and the clothes being ironed.

U.S. Pat. No. 3,049,826 pertains to an ironing board cover formed from an asbestos-impregnated woven textile.

U.S. Pat. No. 3,148,467 discloses a cover of glass cloth, cotton, cotton with a silicone covering, or cotton with a plastic coating.

U.S. Pat. No. 3,414,995 discloses an ironing board cover having a central ironing panel of silicone rubber-impregnated woven glass fabric. Such a composition is insufficient to impart the necessary frictional force between the articles being ironed and the ironing board surface to prevent sliding of the articles.

U.S. Pat. No. 3,733,724 discloses an ironing board pad having a cover comprising a stretchable heat-resistant knit material.

U.S. Pat. No. 3,911,603 discloses a fabric ironing board cover having a plurality of closely-spaced apertures. The apertures have the effect of roughening the ironing surface.

U.S. Pat. No. 4,043,062 discloses an ironing pad for table-top use. A skid resistant coating is included on the underside of the pad, but not on the ironing surface. U.S. Pat. No. 4,360,984 discloses a similar table-top ironing pad having a cotton cover coated with a synthetic resin, but the resin is intended to improve heat resistance and minimize, rather than maximize, friction between the ironed aritcles and the pad.

These prior art ironing board covers are ineffective in preventing slippage of articles being ironed from the ironing board surface under the action of gravity. What is needed is a non-skid cover which is stable at ironing temperatures, easy to manufacture, and which provides a high degree of frictional contact with articles being ironed.

SUMMARY OF THE INVENTION

A cover for an ironing board or pressing machine is provided. The cover is composed of a fabric, at least a portion of which has a non-skid surface stable at ironing temperatures.

The non-skid surface may extend substantially over the entire surface of the cover, or may be restricted to the periphery of the ironing surface. The non-skid surface may be discontinuous. It may extend over the edge of the ironing surface to encompass the side skirts of the cover. It is most advantageously formed by a coating of an acrylic polymer. The preferred coating is formed from a composition of about 50–95% of an aqueous acrylic emulsion, about 0.5–3.0% thickener, about 0.5–2% thickener activator, about 0.5–5% humectant, and water.

It is therefore an object of the invention to provide an inexpensive but effective cover for an ironing board or pressing machine having a non-skid surface.

It is an object of the invention to provide an ironing surface which prevents sliding of articles being ironed during the ironing operation.

It is an object of this invention to provide for essentially one-handed ironing.

It is a further object of the invention to provide an ironing surface with non-skid characteristics such that shear fabrics may be ironed without distortion resulting from sliding or stretching during ironing.

Finally, it is an object of the invention to provide a process for forming a non-skid surface on a fabric ironing board cover.

Other objects and advantages will appear hereinafter.

DETAILED DESCRIPTION OF THE INVENTION

Unless specifically indicated otherwise, all percentages expressed herein are volume percents. The ironing board cover of the present invention is composed of a layer of fabric which has the general outline of a typical ironing board, but its edges or "side skirts" extend beyond the edges of the ironing board surface. The fabric may be a woven, knitted or non-woven textile material which will resist the heat and pressure of the ironing process. Such fabrics are well-known in the art and are readily available commercially. The preferred fabric material is cotton or a blend thereof.

It is known to coat cotton ironing board covers with metallic or slick plastic coatings. These surfaces, without some form of non-skid coating, are ineffective in preventing slippage of articles being ironed. Although synthetic or natural rubber may be used for a non-skid surface, they are less desirable because of the tendency to yellow and brown as well as becoming brittle and unstable.

Any of several known polymeric materials having non-skid properties may be affixed to the ironing side of the fabric in accordance with the present invention. Appropriate non-skid polymer coatings may be applied to the fabric in solution form. The solvents can be aqueous or non-aqueous. Likewise, the polymer may be in emulsion form. Preferred materials include acrylic polymer emulsions or mixtures thereof, particularly self-reactive acrylics such as "RHOPLEX K-14", available from Rohm & Haas Co., Philadelphia, Pa. Acrylic polymer coatings have the advantage of imparting increased abrasion resistance to the fabric.

The non-skid surface may be imparted to the fabric by a variety of well-known methods. Appropriate polymer coatings can be applied by knife coating, roller coating, flat bed screen printing, rotary screen printing or unit printing. The coating may also be applied by dipping the fabric in a bath of the coating material. Curing of the polymer, if necessary, takes place at elevated temperature.

The materials may be imparted to the fabric by other means such as weaving fibers of polymeric non-skid material into the fabric, sewing portions of non-skid material to the fabric, or attaching non-skid sheet materials by fusion, lamination or other means known to those skilled in the art.

In one embodiment of the invention, the non-skid coating extends over the entire ironing surface of the fabric. Preferably, the non-skid coating is restricted to the periphery of the ironing surface, most advantageously in a regular or irregular border extending outward up to two and one-half inches from the edge of the ironing surface. The border may be continuous or interrupted. Where the ironing board cover is provided with a silk-screened border design, the non-skid materials may be mixed with the coloring materials for the design. The result is a non-skid artistic border design on a background of cotton fabric.

The non-skid coating may advantageously be continued over the edge of the ironing surface downward onto the side skirts of the cover. I have found that coating the border and side skirts of the cover with non-skid material is particularly effective in preventing sliding of the articles being ironed from the ironing surface.

The ironing board cover of the present invention may contain a padding layer having the same shape as the fabric cover. The padding is preferably formed from a polymeric material such as foam polyurethane. The padding may be attached by a thermoplastic adhesive as described in my U.S. Pat. No. 3,911,603 to form a wrinkle-proof laminate. The edges of the fabric may contain binding or welting through which a drawstring or elastic band is run so that the cover may be secured onto the ironing board.

The ironing board cover may contain one or more layers of heat reflective materials such as pure aluminum flakes or inert material insulating materials, which may be dispersed in acrylic resin binders bonded between the fabric layer and the padding. Such an arrangement has the advantage of increasing the effectiveness of ironing since heat loss through the fabric and padding layers is reduced. Alternatively, the fabric material may itself be coated with a metallic heat reflective material as described in U.S. Pat. No. 3,049,826, or in my U.S. Pat. No. 4,485,400. The heat reflective material should be applied so as not to interfere with the desired non-skid properties.

In one embodiment of the invention, a non-skid surface is applied in the form of a coating composition containing one or more acrylic polymers in an aqueous emulsion. The composition further includes binding and thickening agents compatible with the acrylic emulsion. Additional acrylic polymers may function as these binding or thickening agents. "POLYCRIL G-9", an acrylic polymer from Polymer Industries is useful as a binding agent, while "ASE-60" from Rohm & Haas, another acrylic polymer, may be used as a thickener. The acrylic emulsion comprises about 50–95% of the composition.

The acrylic coating composition may further contain antifoaming agents, particularly of the mineral oil or vegetable oil type. The anti-foamer may include a surfactant to distribute the oil. Antifoamer #50601, available from the Inmont Division of United Technologies, is an example of a suitable antifoamer. It contains a 70–80% base of mineral oil with additional surfactants.

If heat reflection is desired, the composition may additionally contain a heat-reflective metal, particularly aluminum, in the form of a leafing paste. When a metal paste is added to the composition, an emulsifying agent such as ethylene oxide should be included.

Other ingredients include thickening activators and humectants.

A coating composition for application by rotary screen printing thus contains about 50–95% of an aqueous acrylic emulsion, about 0.5–3% thickener, about 0.5–2% ammonia to activate the thickener and stabilize the composition against mechanical shear during the printing process, about 0.5–5% of a suitable humectant, about 0.1–2% antifoamer, the balance being water. Urea, propylene glycol, glycerine and mixtures thereof may be used as humectants. The humectant most preferred comprises a mixture of 0.5–2% urea and 1–3% propylene glycol, relative to the total composition. The humectant prevents drying of the composition on the rotary screen during printing. If heat-reflection is desired, the composition additionally contains about 1–3% aluminum paste and about 0.1–1.0% ethylene oxide. The coating composition is exemplified as follows:

EXAMPLE 1

1408 oz. non-skid acrylic polymer emulsion (RHOPLEX K-14, Rohm & Haas)
896 oz. binder (POLYCRIL G-9, Polymer Indus.)
20 oz. thickener (ACRYSOL ASE-60, Rohm & Haas)
20 oz. ammonia
20 oz. urea
30 oz. propylene glycol
40 oz. aluminum leafing paste (#2462, Alcan Co.)
8 oz. ethylene oxide
15 oz. anti-foaming agent (#50601, Inmont)
up to 20 gal. water The components were mixed at 3600 RPM at room temperature for about seven minutes then applied to a bolt of 100% cotton by a rotary screen printer. The coated fabric was immediately dried in a gas dryer operating at 350° F. at a feed rate of 22 yards per minute. Both temperature and feed rate may be varied to suit the requirements of the particular composition.

I have found that twenty gallons of the composition according to Example 1 is sufficient to finish about 400 yards of fabric to a thickness adequate to provide the anti-skid characteristics which I seek. Glycerine may be substituted for propylene glycol in Example 1.

While the coating composition may be applied to coat the entire surface of the ironing board cover, the non-skid coating may advantageously be restricted to a border area extending around the periphery of the ironing surface. Where it is desired to produce an ironing board cover with an artistic border design, the non-skid composition is mixed with coloring materials and applied by rotary screen printer or other printing means to form a non-skid border design. Additional thickening agents are used to make a print paste. Compositions for this purpose, sufficient to finish 550 yards of fabric with an artistic floral border design, were prepared as follows:

EXAMPLE 2

704 oz. RHOPLEX K-14
256 oz. POLYCRIL G-9
10 oz. ASE-60
10 oz. ammonia
10 oz. urea
15 oz. propylene glycol
21.5 oz. pigments
4 oz. Hif Carrier (#59242, Inmont)
up to 10 gal. water

EXAMPLE 3

832 oz. RHOPLEX K-14
256 oz. POLYCRIL G-9
14 oz. ASE-60
14 oz. ammonia
14 oz. urea
20 oz. propylene glycol
21.5 oz. pigments
4 oz. Hif Carrier (#59242, Inmont)
up to 10 gal. water The present invention may be embodied in other specific forms without departing from the spirit or essential attributes thereof and, accordingly, reference should be made to the appended claims, rather than to the foregoing specification, as indicating the scope of the invention.

I claim:

1. A cover for an ironing board or pressing machine which has an ironing surface and side skirts when covering the ironing board or pressing surface of the pressing machine and comprises a fabric at least a portion thereof having a coating of an acrylic polymer composition which (1) provides a non-skid surface at room temperature, (2) prevents the article being ironed or pressed from falling off the ironing or pressing surface, and (3) is stable at ironing or pressing temperatures.

2. A cover according to claim 1 wherein the non-skid surface extends over substantially the entire cover.

3. A cover for an ironing board or pressing machine which comprises a fabric at least a portion thereof having a coating of an acrylic polymer composition which (1) provides a non-skid surface at room temperature, (2) prevents the article being ironed or pressed from falling off the ironing or pressing surface, and (3) is stable at ironing or pressing temperatures wherein the non-skid surface is restricted to the periphery of the ironing surface.

4. A cover in accordance with claim 3 wherein the non-skid surface is discontinuous.

5. A cover according to claim 3 wherein the non-skid surface extends over the edge of the ironing surface to encompass the side skirt of the cover.

6. A cover for an ironing board or pressing machine having on at least a portion thereof a non-skid surface stable at ironing temperatures, said non-skid surface formed by applying a mixture to the cover comprising about 50–95% aqueous acrylic emulsion, about 0.5–3.0% thickener, about 0.5–2% thickener activator, about 0.5–5% humectant, and water.

7. A cover according to claim 6 wherein the humectant is selected from the group consisting of urea, propylene glycol, glycerine, and mixtures thereof.

8. A cover according to claim 7 wherein the humectant comprises about 0.5–2.0% urea and about 1–3% propylene glycol, and wherein the thickener activator is ammonia.

9. A cover according to claim 6 wherein the mixture additionally contains about 0.1–2% anti-foaming agent.

10. A cover according to claim 6 made heat-reflective by including therein an amount of heat-reflective material.

11. A cover according to claim 10 wherein the mixture contains about 1–3% aluminum paste as the heat-reflective material and about 0.1–1.0% ethylene oxide.

* * * * *